US005836137A

United States Patent [19]

Contreras et al.

[11] Patent Number: 5,836,137

[45] Date of Patent: Nov. 17, 1998

[54] TYING APPARATUS

[76] Inventors: Luis C. Contreras, 1701 Steinbeck St., Placentia, Calif. 92670; Roger S. Kincel, 4928 Loma Laguna Dr., Carlsbad, Calif. 92008

[21] Appl. No.: 934,919

[22] Filed: Sep. 22, 1997

[51] Int. Cl.[6] ..... B65B 51/08

[52] U.S. Cl. ..... 53/138.8; 53/76; 100/31; 140/93.6

[58] Field of Search ..... 53/138.8, 370, 53/583, 76; 100/31; 140/57, 93 A, 93.6; 29/243.57; 91/283, 306

[56] References Cited

U.S. PATENT DOCUMENTS

| | | | |
|---|---|---|---|
| 3,157,109 | 11/1964 | Flanigan | 100/31 |
| 3,183,824 | 5/1965 | Cook | 100/31 |
| 3,354,915 | 11/1967 | Johnson | 53/138.8 |
| 3,369,573 | 2/1968 | Baker et al. . | |
| 3,590,885 | 7/1971 | Ward . | |
| 3,721,061 | 3/1973 | Bodolay | 53/135 |
| 3,821,058 | 6/1974 | Miller . | |
| 3,825,039 | 7/1974 | Crabb | 140/93 |
| 3,970,117 | 7/1976 | Zamansky et al. . | |
| 4,054,160 | 10/1977 | Knudsen . | |
| 4,354,535 | 10/1982 | Powell | 140/93 |
| 4,362,192 | 12/1982 | Furlong et al. . | |
| 4,655,264 | 4/1987 | Dilley | 140/93.6 |
| 4,865,087 | 9/1989 | Geiger . | |
| 4,907,392 | 3/1990 | Knudsen | 53/138.8 |
| 4,953,598 | 9/1990 | McCavey . | |
| 5,177,937 | 1/1993 | Alden | 53/479 |
| 5,217,049 | 6/1993 | Forsyth . | |
| 5,465,549 | 11/1995 | Lummus | 53/138.8 |
| 5,558,012 | 9/1996 | Yamashima | 100/26 |
| 5,613,530 | 3/1997 | Kincel et al. . | |

*Primary Examiner*—Daniel Moon
*Assistant Examiner*—James P. Calve
*Attorney, Agent, or Firm*—Gordon K. Anderson

[57] ABSTRACT

The improvement to the tying apparatus consists of an intermittent rotatable pneumatic drive to operate the apparatus in place of the electric drive system. The pneumatic drive includes a rotary actuator (20) with a gear arrangement and one-way clutch (26) that provides the 360 degree rotation required to operate the apparatus. A control valve (36) with a single pilot control energizes the actuator clockwise for functional operation and counterclockwise to reset, ready for a subsequent operation. A roller actuated limit valve (42) is in communication with the apparatus program plate and, when mechanically triggered, energizes the pilot portion of the control valve, driving the program plate a full 360 degrees, completing a functional operation of encircling, gathering, twisting and cutting tie material around an article, such as a bag, sack, or other like-open mouth articles. A pneumatic valve (48) with a pushbutton (50) bypasses the manual trigger system of the apparatus in the event of malfunction or jam, allowing the device to reset itself into the ready to operate position.

18 Claims, 6 Drawing Sheets

TYING APPARATUS

TECHNICAL FIELD

The present invention relates to tying apparatus in general. More specifically to a twist tie device for tying articles with resilient tie material that operates pneumatically.

BACKGROUND ART

Previously, many types of twist tie apparatus have been used in endeavoring to provide an effective means for producing automatic tying of a bag, sack or other open type container, upon presentation of the article within the device, including cutting the tie material during the operation.

In most cases, this tying apparatus has been limited to electrically operated devices for tying bagged articles. Some prior art, however, uses pneumatic pressure for tying heavy duty wire for connecting reinforcing bars together prior to pouring concrete to maintain alignment and strength of the reinforced concrete structure. Twist tie material for food products and the like historically use electric power as the motivating force employing both electric motors and electromagnetic solenoids.

While the operation of looping, cutting, and twisting wires is all basically similar, those advanced specifically for reinforcement bar must be large and robust, as the wire attachment must have sufficient strength to insure that the reinforcing bars are not displaced while pouring heavy fluid concrete directly over the joint. Dedicated motors and solenoids have also been used in conjunction with lever arms and gears to provide the needed strength and stoutness for this application and, as such, are large and powerful, which is unnecessary for twist tie material.

A search of the prior art did not disclose any patents that read directly on the claims of the instant invention, however, the following U.S. patents are considered related:

| Patent No. | Inventor | Issue Date |
|---|---|---|
| 5,613,530 | Kincel et al | Mar. 25, 1997 |
| 5,217,049 | Forsyth | Jun. 8, 1993 |
| 4,953,598 | McCavey | Sep. 4, 1990 |
| 4,865,087 | Geiger | Sep. 12, 1989 |
| 4,362,192 | Furlong et al | Dec. 7, 1982 |
| 4,054,160 | Knudsen | Oct. 18, 1977 |
| 3,970,117 | Zamansky et al | Jul. 20, 1976 |
| 3,821,058 | Miller | Jun. 25, 1974 |
| 3,590,885 | Ward | Jul. 6, 1971 |
| 3,369,573 | Baker et al | Feb. 20, 1968 |

Kincel et al discloses, in U.S. Pat. No. 5,613,530, a hand held twist tie apparatus that utilizes an electric motor and reduction gears to reduce the motor speed and a drive gear cluster with a turntable to actuate a shuttling carriage and twister arm. Direct current electric power is supplied by a power converter plugged into city power, or a rechargeable storage battery attached to the operator.

Forsyth, in U.S. Pat. No. 5,217,049, teaches a portable, hand operated power tool that automatically ties intersecting rebar. The device employs an electric drill motor as the rotating power source. The drill motor selectively engages a housed transmission and jaw assembly that encircles the workpiece. Wire is stored on a belt mounted reel and fed around guide channels integral with the jaws. Electromagnets control retractable levers preventing rotation, however, when withdrawn, the drill motors motion rotates the device to produce a twist tie of the wire.

U.S. Pat. No. 4,953,598 of McCavey discloses a hand held power tool also for rebar connection. The tool includes a body that houses the operating components and provides a wire reel holder, handle with trigger and support for the wire channel guide that momentarily surrounds the rebar joint. The rebar tying wire is fed through the housing with rollers to a circular turret, including two side-by-side clamping jaws which hold one end of the wire. The feed wheels reverse, thereby removing the slack for the wire and tighten the rebar joint. The other end of the wire is clamped and cut, then the entire turret, including the attaching jaws, is rotated to twist the wire ends together after the channel guide is rotated from the joint. Three motors and four electromagnetic solenoids are used to provide the torque and linear force for the device.

Geiger's U.S. Pat. No. 4,865,087 is for a wire tying mechanism basically utilized for tying concrete reinforcing rods prior to pouring liquidous concrete. The device is hand held and utilizes pneumatic air pressure, or electric motors to actuate the twisting function. The preferred embodiment employs linear actuators, such as pneumatic pistons and spur gears engaging a spur gear rack for rotary movement and a splined shaft within a linear actuator for tightening the wire against the workpiece.

Furlong et al U.S. Pat. No. 4,362,192 again, is directed to rebar tying. A fixed and a movable jaw is clamped around the rebar joint and a predetermined length of wire is fed into guiding grooves within the jaws forming a loop. The end of the wire is cut to length by a cutter bar on a rotatable mandrel having opposed radial flange sections. Relative rotation of the inner mandrel to an outer mandrel performs the wire cutting and twisting. Controls provide proper positioning of the openings for passage of wire upon each operational cycle. An electric motor and gear reduction arrangement, with a clutch and brake, provide the rotational torque and a series of solenoids open and close the jaws and provide timing sequence functions of rotation.

Knudsen's U.S. Pat. No. 4,054,160 is for a stationary tying machine for tying articles of various sizes using a twist tie ribbon. Specifically, this device is for tying articles up to two inches in diameter with adjustment capabilities. Drive means consists of two individual drive motors. The main drive motor powers all of the operations, except the ribbon feed, which is the function of the ribbon drive motor. The main drive motor rotates continuously and employs a single revolution clutch to create the force for the looping, twisting and cutting function. Feed rollers and guides deliver and advance the ribbon, as actuated by the second motor, and a spool brake is provided for the ribbon spool. Relays, switches and solenoids are used for electric control.

U.S. Pat. No. 3,970,117 issued to Zamansky et al presents a twister for wire ties that incorporate loops on both ends of a short length of wire. The wire ties are manually placed around the object to be fastened and a hook is inserted into both wire loops. When the handle of the twister is manually pulled away from the wire, the integral D.C. motor is engaged, rotating the hook and completing the twisting procedure. When pulling force is released, the motor is disengaged by spring pressure.

Miller's U.S. Pat. No. 3,821,058 is directed to fastening a length of thermoplastic, resin coated harness cable lacing tape around a cable bundle by twisting, fusing, and cutting the tape. The hand held tool contains a motor which rotates a tubular drive shaft with a twisting end. The heating and severing function is contained within the jaws retracted into a tool barrel. Lacing tape is supplied through a shaft and is manually looped around the cable bundle with the free end attached to the twisting member. The drive shaft is rotated, which twists the tape, and simultaneously the jaws are extended, which severe and fuse the tape.

U.S. Pat. No. 3,590,885 of Ward teaches a hand tool for tying rebars with a twist that avoids bunching or piling of the convolutions of the tie on top of one another. Spring loaded plates, that are shiftable, are located on one end of the tool body, which are rearranged by the ends of the wire loop during the twisting operation, such that the entire body moves away from the work piece. The power is provided by pneumatic air pressure.

U.S. Pat. No. 3,369,573 issued to Baker et al is the progenitor to which the present improvement is directed. This apparatus has been in production and successfully utilized by the public since its inception in the 1960's. This mechanism employs storage of a reel of tie material, feeding means, and severing and twisting means to wrap the material around the product when mechanically triggered by pressing the workpiece into the throat of the device. Actuation of the apparatus is provided by a continuously rotating electric gear-motor equipped with a one-way clutch or combination electric motor-brake controlled by a snap-action switch. In any event, a mechanical program plate completes one revolution providing the operational sequence for the tying apparatus.

It may be seen that the prior art exclusive of the Baker et al, Knudsen and Kincel et al patents incorporate large, heavy, robust mechanisms that employ robust pneumatic power or electrical drives requiring numerous separate motors, clutches, brakes, and electromagnetic solenoids, etc., to accomplish the task at hand.

DISCLOSURE OF THE INVENTION

The tying apparatus protected by U.S. Pat. No. 3,369,573 has been in production and a financial success for over three decades, however, changes in methods of packaging and transporting produce have altered the needs and requirements of this type of equipment.

It is, therefore, a primary object of the invention to improve the apparatus, such that washing down the entire device is practical. The present tying device covered by the above described patent includes electric controls and an open type motor or motor brake combination that would become damaged or inoperative if cleaning with a liquid, such as soap and water, were to be used on a routine basis. While the initial usage for this tying apparatus was to tie the tops of bags, or any type of pouch, sack, receptacles or articles without bags, the primary application has been to fasten open topped produce bags. While some products, such as bakery goods or general dry goods, are relatively clean and leave little residue, some fruit and vegetable bags may leak and contaminate the apparatus, particularly when accidently torn or broken open. When the goods have a high sugar or acid content, the problem is accentuated and, if not cleaned thoroughly, become a health hazard and contaminate the equipment, even to the extent of complete malfunction and would obviously become offensive to the operator, as well as dangerous to the public. The present improvement permits complete and thorough cleaning with conventional methods, such as spraying with water from a faucet, hose, or the like, or immersion in soapy water as, no electrical components are utilized.

An important object of the invention is that the improved apparatus becomes explosive-proof, since there are no arc producing electrical switches or motors with brushes. While most applications do not demand this requirement, some fine ground grains, and the like, in powder form, have the potential for ignition in predisposed circumstances and, therefore, the improvement permits expanded usage in this marketplace.

Another object of the invention amplifies the tying apparatus utility, as in todays agriculture market, fruits and vegetables are not only picked, cleaned and inspected in the field, but packaged and field loaded into refrigerated trucks and trailers for transportation. Many mechanical pickers and platforms include pneumatic pressure for operation, permitting a tying apparatus operable with this power source to be easily applied.

Still another object of the invention is directed to the ability of the device to operate at conventional air pressures without intricate regulation. The improved apparatus will function normally with air pressure ranging from 60 to 120 pounds per square inch (414 to 827 KPag), which is well within the range of most applicable pneumatic equipment common within this country.

Yet another object of the invention is to limit the modification to the minimum changes necessary to eliminate costly tooling changes and needless engineering. It will be noted that the improvement does not change the function of the tying apparatus in any manner, but extends its utility with minimum expenditures.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the invention is presented in terms of a preferred embodiment.

Figure 4:
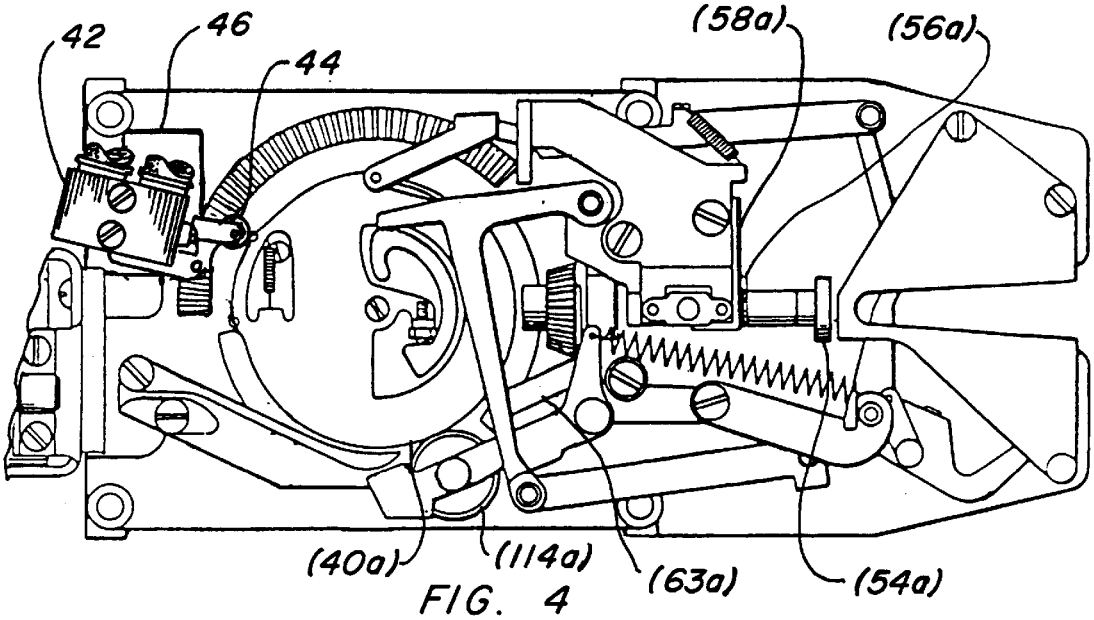
FIG. 4 is a partial plan view of the tying apparatus with the enclosure and material roll removed for clarity.
Figure 5:
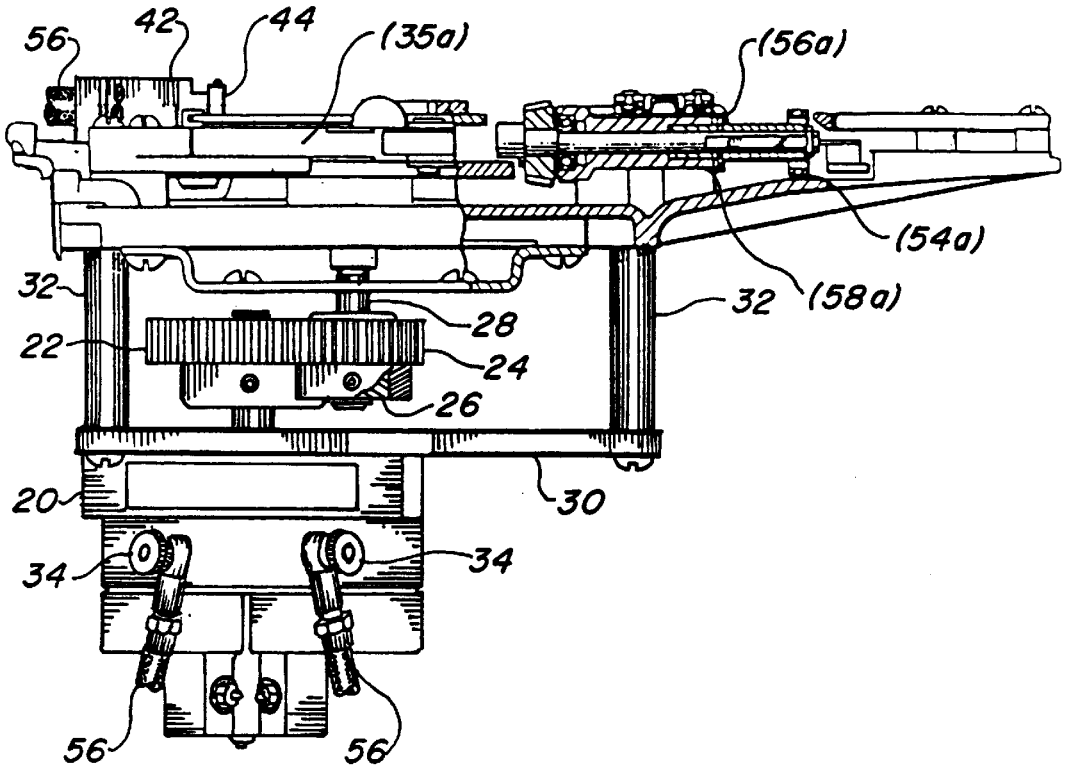
FIG. 5 is a side elevational view of the internal mechanism shown partially cut-away, as a cross-sectional view taken along the longitudinal centerline.
Figure 6:
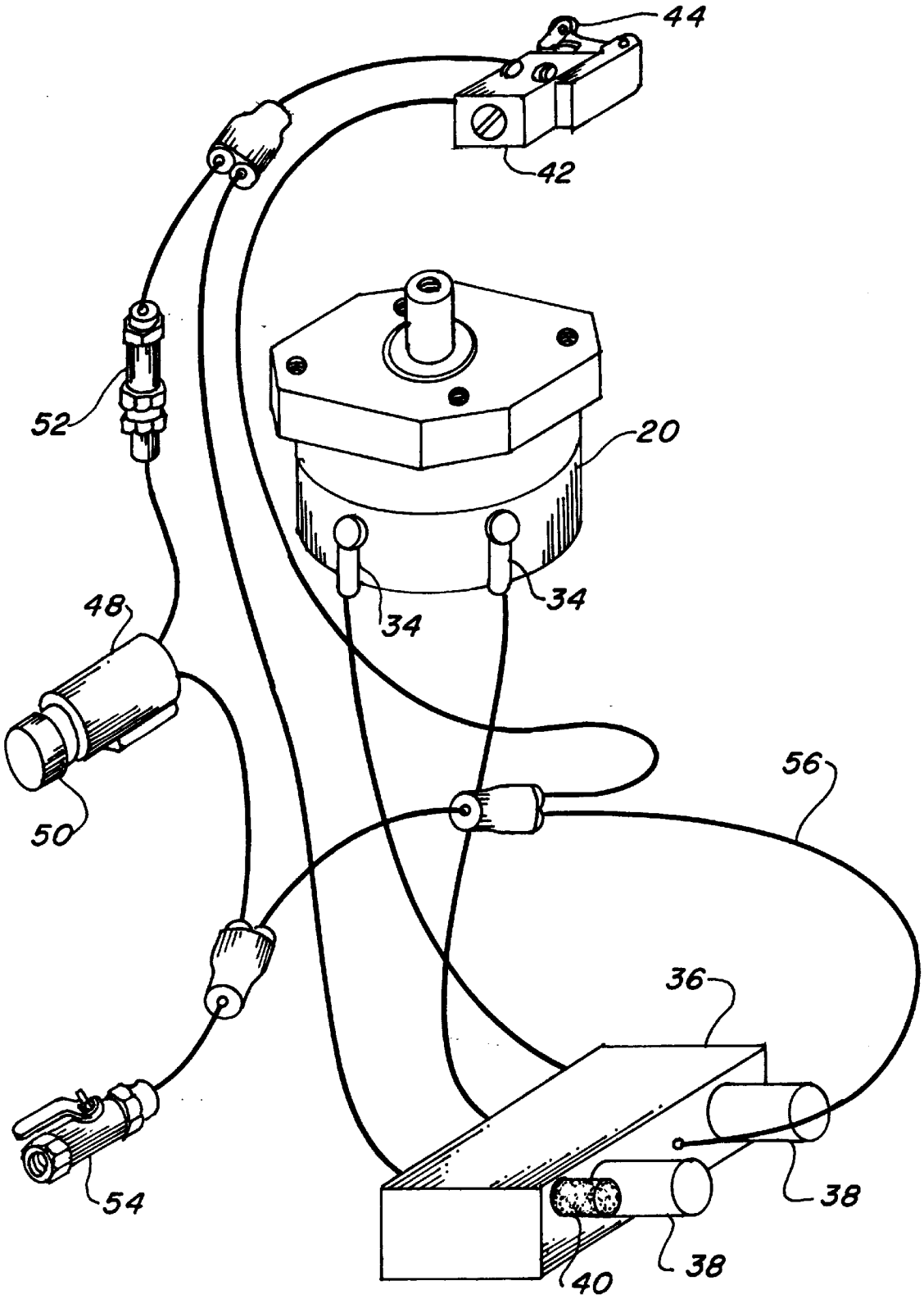
FIG. 6 is a pictorial schematic of the pneumatic drive with its functional components oriented in their essential relationship with interconnection illustrated in single lines representing plastic hose and fittings.
Figure 7:
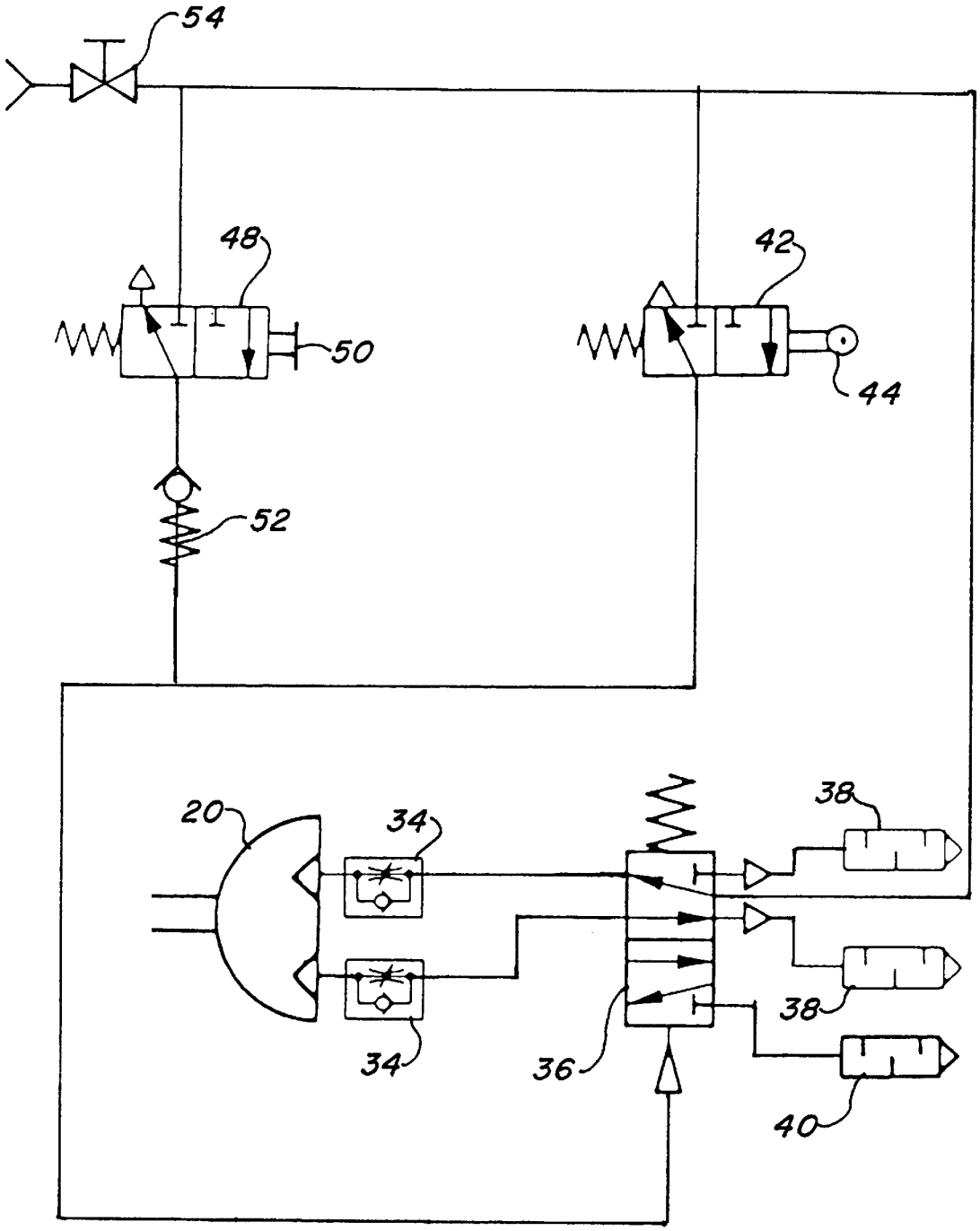
FIG. 7 is a schematic of the pneumatic system of the intermittent rotatable pneumatic drive.
Figure 8:
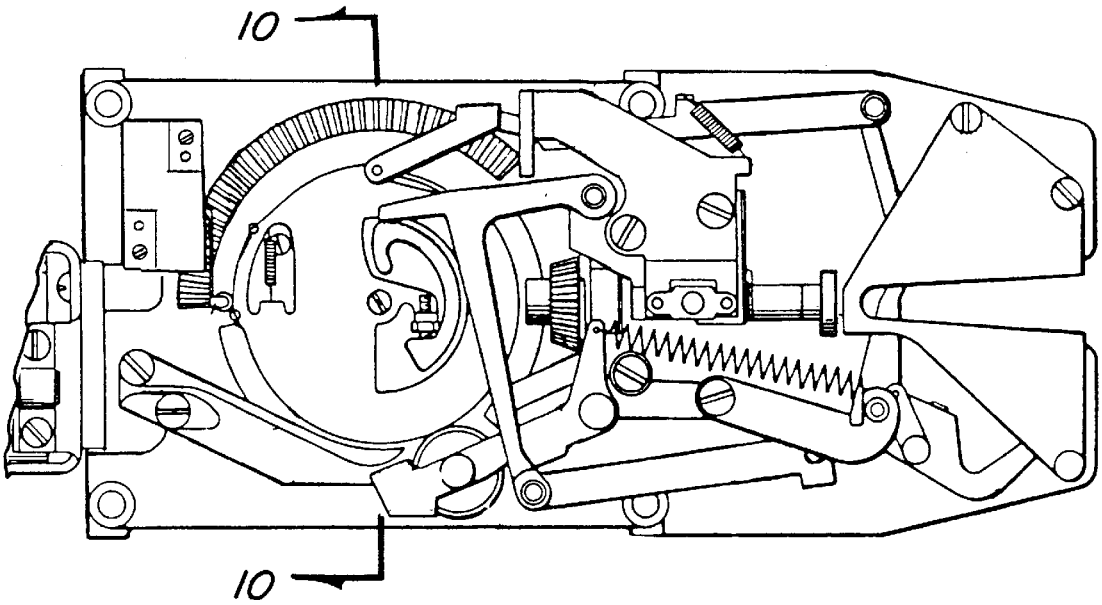
FIG. 8 PRIOR ART
FIG. 8 is a top view of the prior art with the cover removed.
Figure 9:
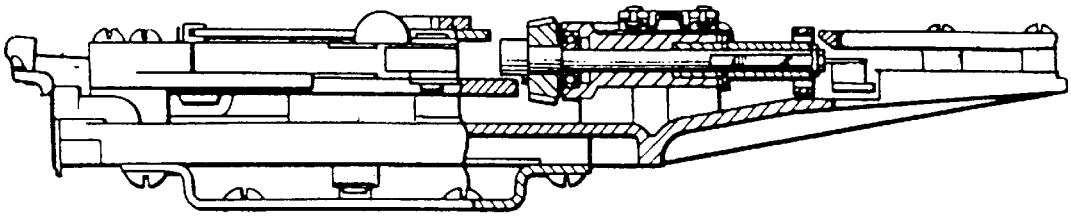
FIG. 9 PRIOR ART
FIG. 9 is a side elevational view of the prior art shown partially cut-away, as a cross-sectional view taken along the longitudinal centerline.
Figure 10:
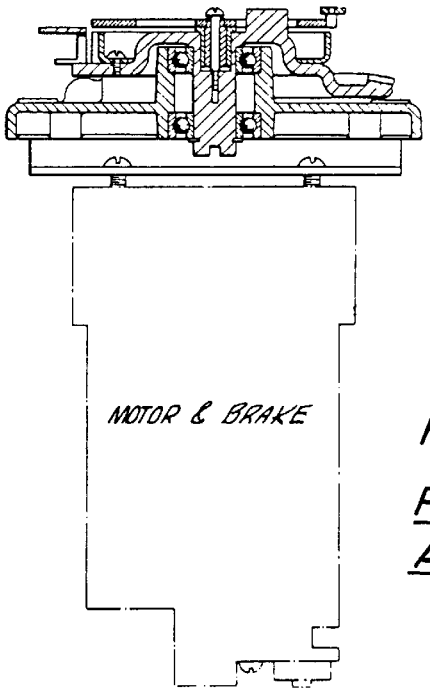
FIG. 10 PRIOR ART
FIG. 10 is a cross-sectional view taken along lines 10—10 of FIG. 8 and illustrating the motor and brake in dotted outline.

The preferred embodiment of the improvement to the tying apparatus disclosed in U.S. Pat. No. 3,369,573, issued to Baker et al on Feb. 20, 1968, therefore the entire contents are included by reference particularly the modified embodyment and as such should be considered essential material. The improvement is comprised of replacing the electrical motor, clutch, gearbox or switch controlled motor and brake with a pneumatic drive. This improvement replaces only a small number of components, however, the change in its functional operation is substantial, opening up applicability in fields not heretofore utilized. The major elements of the tying apparatus of the forementioned patent '573 remain unaltered and this prior art is illustrated in FIGS. 8–10, as they substantially appear in the issued patent. With this in mind, only applicable identification of the elements is deemed necessary, and are shown and noted with their original element numbers in parenthesis and suffixed with the letter "a", further reference may be made to the patent '573 for a detailed description of its remaining structure and functional operation. FIGS. 4 and 5 illustrate the improvements in bold outline and shading for ease of recognition. The schematics depicted in FIGS. 6 and 7 illustrate the pneumatic drive and the interrelationship of operational components.

The intermittent rotatable pneumatic drive of the improvement is comprised of a pneumatic rotary actuator 20, with means to provide an angular rotational movement of 360 degrees, thereby completing one full and complete revolution. The actuator 20 is the vane-type having an internal rotary chamber with a vane between opposed inlet and outlet ports and flexible end position cushioning. Vane type actuators, in general, have rotational capabilities of up to 270 degrees, as their inherent design must leave room for various parts and flowpaths within the round body. The instant actuator 20 is no exception and therefore, means to provide an angular rotation of 360 degrees is utilized in the form of a pair of multi-toothed gears. A first gear 22 is mounted directly to the rotary actuator shaft and a combined second multi-toothed gear 24 and one-way clutch 26 is mounted on a replacement shaft 28 interfacing with the existing program plate. The teeth of each gear are meshed together with the first gear 22 having a greater number of teeth than the second gear 24. It has been found that 32 teeth on the first gear 22 and 24 teeth on the second gear 24 produce a gear ratio of 1.334 to 1, increasing the rotation of the actuator 20 from 270 degrees to 360 degrees.

The one-way clutch 26 pressed into the center of gear 24 permits only clockwise rotation of the shaft 28 to which it is attached. Clockwise rotation is required by the tying apparatus program plate (35*a*), cutting means and twisting head (54*a*), means for storing and means for feeding. The cutting means consist of a shear blade (56*a*) interfaced with a shear block (58*a*), means for storing includes a spool (14) illustrated in FIG. 10 of referenced U.S. Pat. No. 3,369,573 also storage within metal tubing (63*a*) and means for feeding is comprised a feeding disc (40*a*) and idler (114*a*). In order for the actuator 20 to operate the existing mechanism, the actuator 20 is driven counterclockwise to an at rest position after its initial clockwise actuation of the apparatus. The one-way clutch permits this function, as the apparatus is unaffected when the actuator 20 is driven counterclockwise. When thus rotated, the actuator is then in the proper position at rest, waiting for a subsequent clockwise equipment function.

Figure 3:
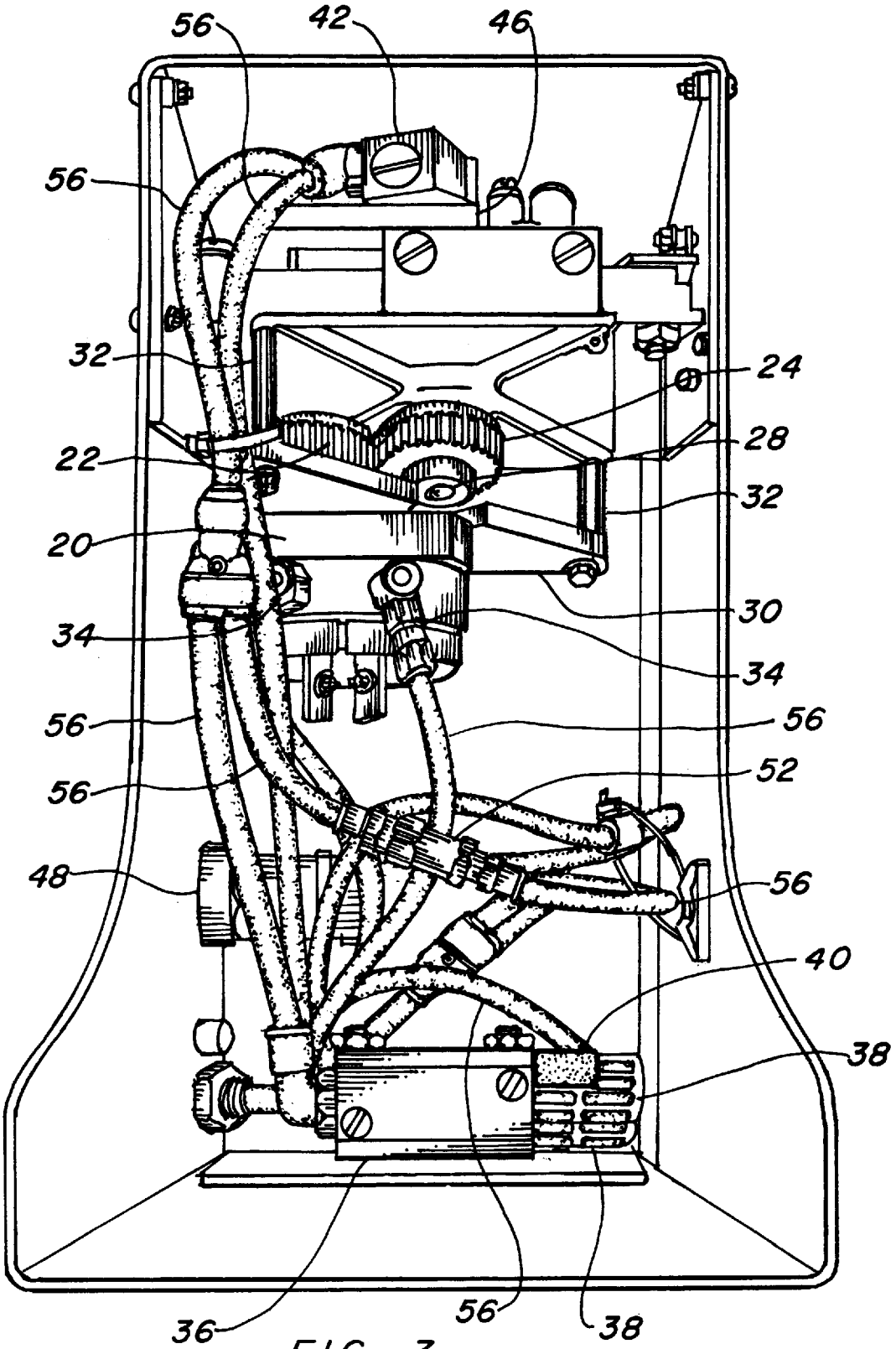
FIG. 3 is a rear perspective view of the tying apparatus with both the rear cover and the material roll removed.

An adapter plate 30 is attached to the existing apparatus with a plurality, preferably three, standoffs 32 mounting the actuator 20 underneath the cutting means and twisting head (54*a*), program plate (35*a*) and means for feeding, as illustrated in FIG. 3. The actuator 20 simulates structure to hold the first gear 22 in intermeshed relationship with the second gear 24 that is held in place by a replacement shaft 28 cast into the apparatus program plate, which is ultimately supported by a pair of bearings, as illustrated originally in FIG. 10.

A port mounted flow control 34 having a restricting orifice is screwed into each pneumatic port of the actuator 20, as depicted in FIG. 3, and shown schematically in FIGS. 6 and 7. The flow controls 34 regulate pneumatic flow from the system to regulate the speed of the actuator 20.

A control valve 36 is in pneumatic communication with the actuator 20 for driving the actuator in either a clockwise or counterclockwise direction, as schematically depicted in FIGS. 6 and 7. The control valve 36 is a pneumatic spool valve having a pilot connection. When the pilot connection is pressurized, the spool is slid in the opposite direction, as the source reversing the output from the valve.

A pair of plastic silencers 38 are threadably connected to the outlets of the control valve 36 and a sintered metal silencer 40 is screwed into the pilot outlet to reduce noise transmission by reducing air velocity when air pressure is relieved from the control valve.

Single revolution operational programming means is provided in the pneumatic system in communication with the control valve 36. This programming means directs the sequence operation of a single rotation of the program plate of the existing tying apparatus and is in the form of a mechanically actuated limit valve 42 with a roller actuator 44. The roller actuated valve 42 is mounted on a limit valve adapter plate 46, which is, in turn, attached to the existing tying apparatus, as depicted in FIGS. 3 and 5. As previously discussed, and as explained in patent '573 in the motor-brake modified embodiment, the snap acting switch (161) is replaced by the limit valve 42. This existing tying apparatus embodiment utilizes a trigger means, or arm, positioned in the throat of the tying apparatus to intercept the article to be tied, and a series of link arms are responsive to the movement of this trigger arm causing the program plate to rotate 30 degrees. The roller actuator 44 is positioned contiguous with a peripheral surface on the program plate, specifically a raised portion (163*a*). When triggered, the actuator roller 44 rides off of this raised portion opening the limit valve 42, pressurizing the pilot connection on the control valve 36, energizing the rotary actuator 20, causing the program plate to rotate 360 degrees, which is the limit of the actuator's travel. When the single revolution is complete, the roller on the limit valve 42 is again contacted by the raised portion on the program plate, closing the control valve 36 and driving the rotary actuator 20 counterclockwise, resetting it ready for the next operation. This counterclockwise rotation is not transmitted to the program plate, due to the function of the one-way clutch 26 isolating the rotary movement completely, as described earlier.

Reset valve means in the form of a manually actuated spring return pneumatic valve 48, with a pushbutton actuator 50, is provided to reset the apparatus to a "start" or normal "at rest" position in the event of a malfunction or tangle of the tie material. The pneumatic valve 48 is connected parallel with the limit valve 42 and functions in like manner, completing a single revolution of the program plate, thus bypassing the operational programming means completely. The pneumatic valve 48 is mounted in the sidewall of the tying apparatus enclosure, as illustrated in FIGS. 1 through 3 with only the pushbutton 50 exposed.

A check valve 52 is positioned within the pneumatic communication between the control valve 36 and the pneumatic valve 48, preventing back pressure from bleeding through the pneumatic valve 48 when the limit valve 42 is actuated. The check valve 52 is the spring loaded in line poppet type, preferably of brass construction.

Figure 1:
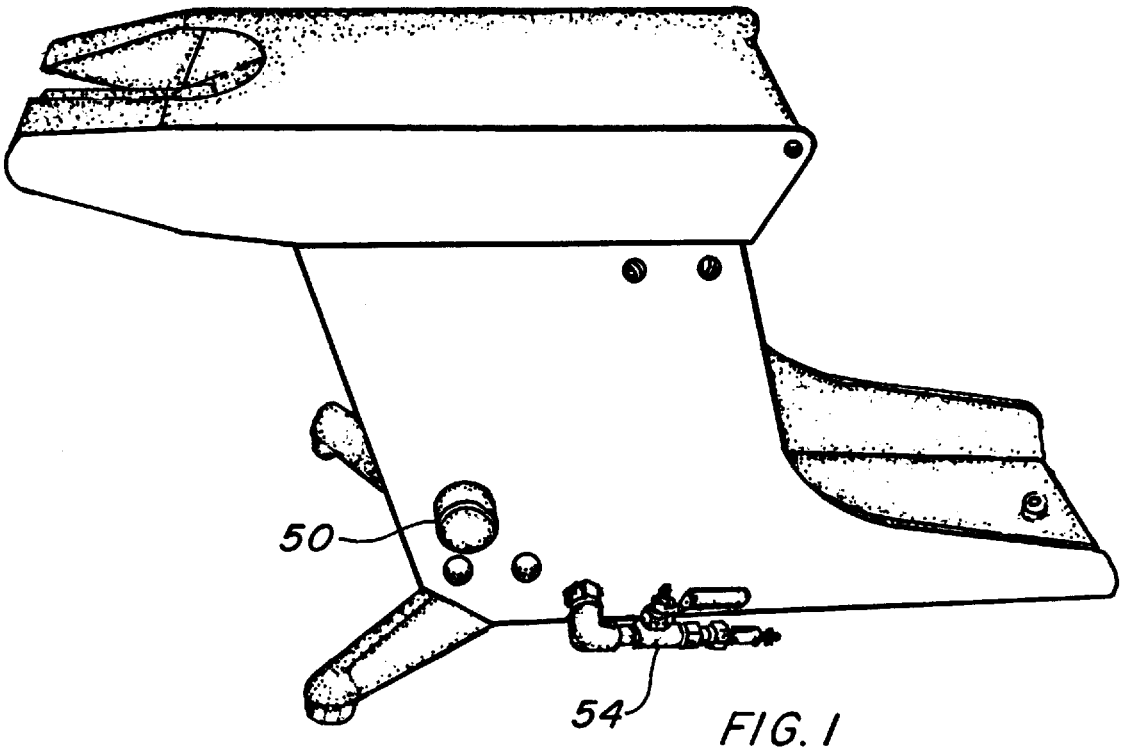
FIG. 1 is a partial isometric view of the preferred embodiment with the protective cover in place and less the roll of tie material.
Figure 2:
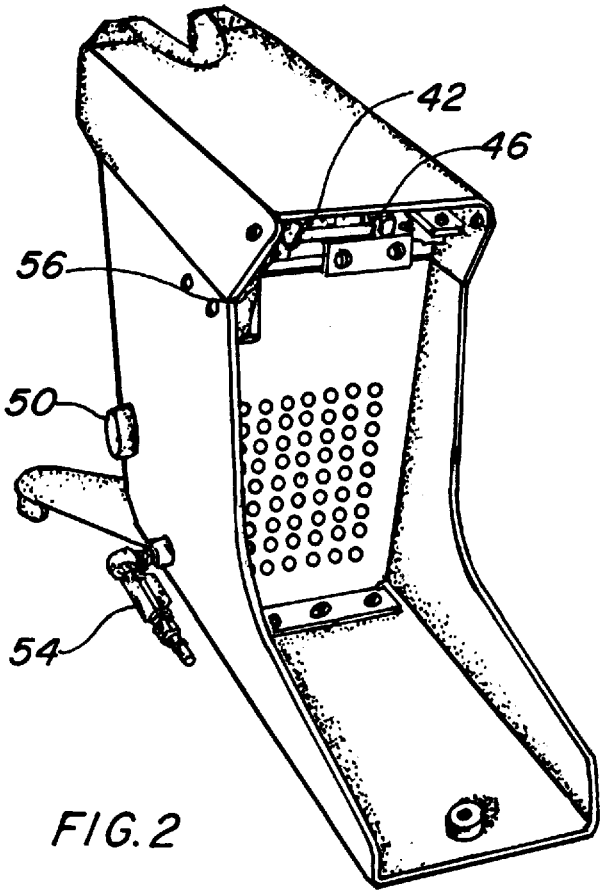
FIG. 2 is a partial isometric view of the preferred embodiment viewed from the rear, also less the tie material roll.

An inlet shut-off valve 54 is installed outside of the apparatus housing, as illustrated in FIGS. 1 and 2, and provides isolation when connecting and disconnecting pneumatic input. The shut-off valve 54 may be any type or configuration, however, a ball-type valve is preferred.

The components described above in pneumatic communication are connected by hose or pipe with a flexible plastic tubing 56, with compression fittings preferred. Connections of the compression type may be of any type or construction well known in the art and common to pneumatic systems.

While the invention has been described in complete detail and pictorially shown in the accompanying drawings, it is not to be limited to such details, since many changes and modifications may be made in the invention without departing from the spirit and scope thereof. Hence, it is described to cover any and all modifications and forms which may come within the language and scope of the appended claims.

What is claimed is:

1. In an apparatus for tying articles with tie material capable of being twisted to form tie having a rotatable cutting means, a twisting head, means for storing a continuous length of tie material, means for feeding a preselected length of the tie material adjacent to, said head into an essentially U-shaped configuration to be operated on by said head, wherein the improvement comprises;

an intermittent rotatable pneumatic drive connected to said feeding means and said twisting head for operating same to cause the preselected length of tie material to be severed from its continuous length and to be simultaneously twisted upon itself and thereby tied about an article during the rotation of said head, said pneumatic drive having, a pneumatic rotary actuator with means to provide an angular rotational movement of 360 degrees, completing a full revolution, a pilot operated control valve in pneumatic communication with said rotary actuator for driving the actuator in clockwise operational direction and a counterclockwise reset direction, single revolution operational programming means in pneumatic communication with said control valve, actuating the control valve to rotate the actuator a single revolution when mechanically triggered by said twisting head and feeding means by supplying and releasing pneumatic pilot pressure to said control valve, and reset valve means in pneumatic communication with said control valve when manually energized initiating and completing a single revolution of said actuator, thereby bypassing said single revolution operational programming means.

2. The intermittent rotatable pneumatic drive as recited in claim 1 wherein said rotary actuator is a vane-type with flexible end position cushioning and rotational capabilities of 270 degrees.

3. The intermittent rotatable pneumatic drive as recited in claim 2 further comprising a port mounted flow control in each actuator pneumatic interface with said control valve for regulating pneumatic flow from the control valve.

4. The intermittent rotatable pneumatic drive as recited in claim 2 further comprising an adapter plate with a plurality of stand-offs mounting the rotary actuator underneath said cutting and twisting head, means for storing and means for feeding.

5. The intermittent rotatable pneumatic drive as recited in claim 2 wherein said means to provide an angular rotation movement of 360 degrees further comprises;

a first multi-toothed gear mounted directly to said rotary actuator and a combined second multi-toothed gear and one-way clutch in meshed communication with the first gear with the first gear having a greater number of teeth than the second, gear such that a 270 degree rotation of the actuator is increased to 360 degrees by their proportional relationship, said one-way clutch allowing only clockwise rotation to be transmitted to the cutting and twisting head, means for storing and means for feeding, thus permitting the actuator to be returned to an at rest position after actuation.

6. The intermittent rotatable pneumatic drive as recited in claim 1 wherein said control valve is a pneumatic spool valve with a pilot connection reversing flow path to said rotary actuator such that pneumatic pressure is communicated from said programming means and reset valve means through the pilot connection, therefore, reversing rotation of the rotary actuator.

7. The intermittent rotatable pneumatic drive as recited in claim 1 further comprising silencers connected to control valve outlets to reduce noise transmission when pressure is relieved from said control valve.

8. The intermittent rotatable pneumatic drive as recited in claim 1 wherein said single revolution operational programming means is a mechanically actuated limit valve with a roller lever actuator.

9. The intermittent rotatable pneumatic drive as recited in claim 8 further comprising a limit valve adapter plate upon which said limit valve is mounted to mechanically attach the limit valve to the apparatus.

10. The intermittent rotatable pneumatic drive as recited in claim 1 wherein said reset valve means is a manually actuated spring return pneumatic valve with a pushbutton actuator.

11. The intermittent rotatable pneumatic drive as recited in claim 1 further comprising a check valve positioned within the pneumatic communication between said control valve and said programming means also reset valve means preventing back pressure from disrupting desired flow direction therebetween.

12. The intermittent rotatable pneumatic drive as recited in claim 1 further comprising an inlet shut-off valve in pneumatic communication with both the programming means and reset valve means to provide isolation of the apparatus when connecting and disconnecting pneumatic input.

13. The intermittent rotatable pneumatic drive as recited in claim 1 wherein said pneumatic communication further comprises flexible plastic tubing and compression fittings.

14. In an apparatus for tying articles with tie material capable of being twisted to form a tie having, a program plate including a feeding disc, mounted on the program plate, an idler rotatably mounted in spaced relation with the feeding disc such that a tie placed between the idler and the feeding disc would be advanced upon rotation of the program plate, a shear block having a passageway therethrough, and a twister head and shear blade, wherein the improvement comprises, pneumatic rotary actuator means rotating the program plate a complete full revolution, a control valve in pneumatic communication with said actuator means directing pneumatic pressure and flow to drive the actuator means, single revolution programming means in pneumatic communication with said control valve providing pilot pressure for control valve direction, and reset valve means in pneumatic communication with said control valve for initiating and completing a single revolution of said actuator when manually energized, therefore, bypassing said single revolution programming means, thus placing the actuator means in a ready to start position.

15. The improved apparatus for tying articles as recited in claim 14 wherein said rotary actuator means is the vane type with a rotation of 270 degrees, and a first multi-toothed gear mounted directly to said actuator means and a combined second multi-toothed gear and one-way clutch in meshed communication with the first gear, with the first gear having a greater number of teeth than the second, such that the 270 degree rotation of the actuator is increased to 360 degrees by their proportional relationship, said one-way clutch allowing only clockwise rotation to be transmitted to the program plate, thus permitting the actuator to be returned to an at rest position after actuation.

16. The improved apparatus for tying articles as recited in claim 14 wherein said control valve is a pneumatic spool valve with a pilot connection reversing flow path to said actuator means, such that pneumatic pressure communication from said programming means and reset valve means through the pilot connection reverses rotation of the actuator means, and silencers are connected to the control valve outlets to reduce noise transmission when pressure is relieved therefrom.

17. The improved apparatus for tying articles as recited in claim 14 wherein said programming means is a mechanically actuated limit valve with a lever mounted roller contiguous with said program plate, such that when mechanically triggered, the program plate revolves sufficiently to cause the roller to ride off of a raised portion of the program plate, energizing the limit valve and providing a single revolution of the program plate, permitting an article to be gathered and a tie twisted thereon.

18. The improved apparatus for tying articles as recited in claim 14 wherein said reset valve means is a manually actuated spring return pneumatic valve with a pushbutton actuator.

* * * * *